United States Patent [19]

Maiorca et al.

[11] Patent Number: 4,967,933

[45] Date of Patent: Nov. 6, 1990

[54] METHOD AND APPARATUS FOR DISPENSING VISCOUS MATERIALS

[75] Inventors: Philip P. Maiorca, Poway; Mark B. Allen, Vista; Duong T. La, San Diego, all of Calif.

[73] Assignee: Asymptotic Technologies, Inc., Carlsbad, Calif.

[21] Appl. No.: 316,425

[22] Filed: Feb. 27, 1989

[51] Int. Cl.[5] ..... B05C 5/02

[52] U.S. Cl. ..... 222/1; 118/697; 118/698

[58] Field of Search ..... 222/1, 23, 160, 173, 222/608, 180–181, 309, 333, 389, 526, 537; 118/207, 211, 216, 696–697, 698; 364/140, 479, 488–490

[56] References Cited

U.S. PATENT DOCUMENTS

| | | | |
|---|---|---|---|
| 4,030,640 | 6/1977 | Citrin et al. | 222/207 |
| 4,056,075 | 11/1977 | Seiderman | 118/696 |
| 4,572,103 | 2/1986 | Engel | 118/697 |
| 4,584,964 | 4/1986 | Engel | 118/697 |
| 4,614,300 | 9/1986 | Falcoff | 239/71 |
| 4,787,332 | 11/1988 | Geisel et al. | 118/692 |
| 4,801,051 | 1/1989 | Lewis et al. | 222/309 |

*Primary Examiner*—Michael S. Huppert

*Attorney, Agent, or Firm*—Baker, Maxham, Jester & Meador

[57] ABSTRACT

A syringe or any other dispensing device is coupled to a conventional dispensing control unit for dispensing viscous material such as adhesives and solder paste through a hollow needle thereof as metered amounts of pressurized gas are supplied to the syringe in response to a valve control signal applied to the dispensing control unit. The syringe is mounted on an automated frame for independent movement along the X, Y and Z axes in response to drive signals. Predetermined pattern and fluid flow functions are selected for each of a plurality of consecutive movement elements by operator actuation of corresponding discrete manually actuable switches to thereby create a workpiece program which can be automatically executed on command to dispense the viscous material over the upper surface of a workpiece such as a PC board in the prescribed manner.

10 Claims, 6 Drawing Sheets

METHOD AND APPARATUS FOR DISPENSING VISCOUS MATERIALS

BACKGROUND OF THE INVENTION

The present invention relates to methods and apparatus for dispensing viscous materials, and more particularly, to an automated method and apparatus for rapid precision dispensing of minute amounts of adhesives, solder paste, and other flowable materials in predetermined patterns at preselected locations on printed circuit boards and other substrates.

In the manufacture of electronic systems and equipment, it is frequently necessary to apply small amounts of viscous or flowable materials onto circuit boards and other substrates. Such materials may include adhesives, solder paste, epoxy, cyanoacrylates, RTV, silicones, solder mask, surface mount adhesive flux, grease, oil, encapsulants, potting compounds, bonding fluids and inks. These materials are often dispensed from a syringe onto a preselected area. Heretofore this type of dispensing has been done manually for small jobs and repairs. Dispensing control units have been commercially available that pneumatically actuate a syringe under foot pedal control. This approach is too tedious and costly to be used on any significant size of production run. More recently, automated systems have been sold by ASYMTEK of Carlsbad, Calif. under the trademark AUTOMOVE (400 Series) for dispensing viscous materials. They have consisted of a benchtop X-Y positioner for carrying and guiding a variety of dispensing heads. The motions required must be programmed via an IBM-PC compatible computer. Menu-driven software is provided for programming the desired movements.

It would be desirable to provide a precision automated viscous material dispenser that could be more easily programmed for different jobs without requiring a separate computer and a skilled programmer.

SUMMARY OF THE INVENTION

It is therefore the primary object of the present invention to provide a readily programmable automated method and apparatus for rapid precision dispensing of minute amounts of adhesives, solder paste, and other flowable materials in predetermined patterns at preselected locations on printed circuit boards and other substrates.

According to the present invention, a syringe is coupled to a conventional dispensing control unit for dispensing viscous material such as adhesives and solder paste through a hollow needle thereof as metered amounts of pressurized gas are supplied to the syringe in response to a valve control signal applied to the dispensing control unit. The syringe is mounted on an automated frame for independent movement along the X, Y and Z axes in response to drive signals. Predetermined pattern and fluid flow functions are selected for each of a plurality of consecutive movement elements by operator actuation of corresponding discrete manually actuable switches to thereby create a workpiece program which can be automatically executed on command to dispense the viscous material over the upper surface of a workpiece such as a PC board in the prescribed manner.

DESCRIPTION OF THE PREFERRED EMBODIMENTS

Figure 1:
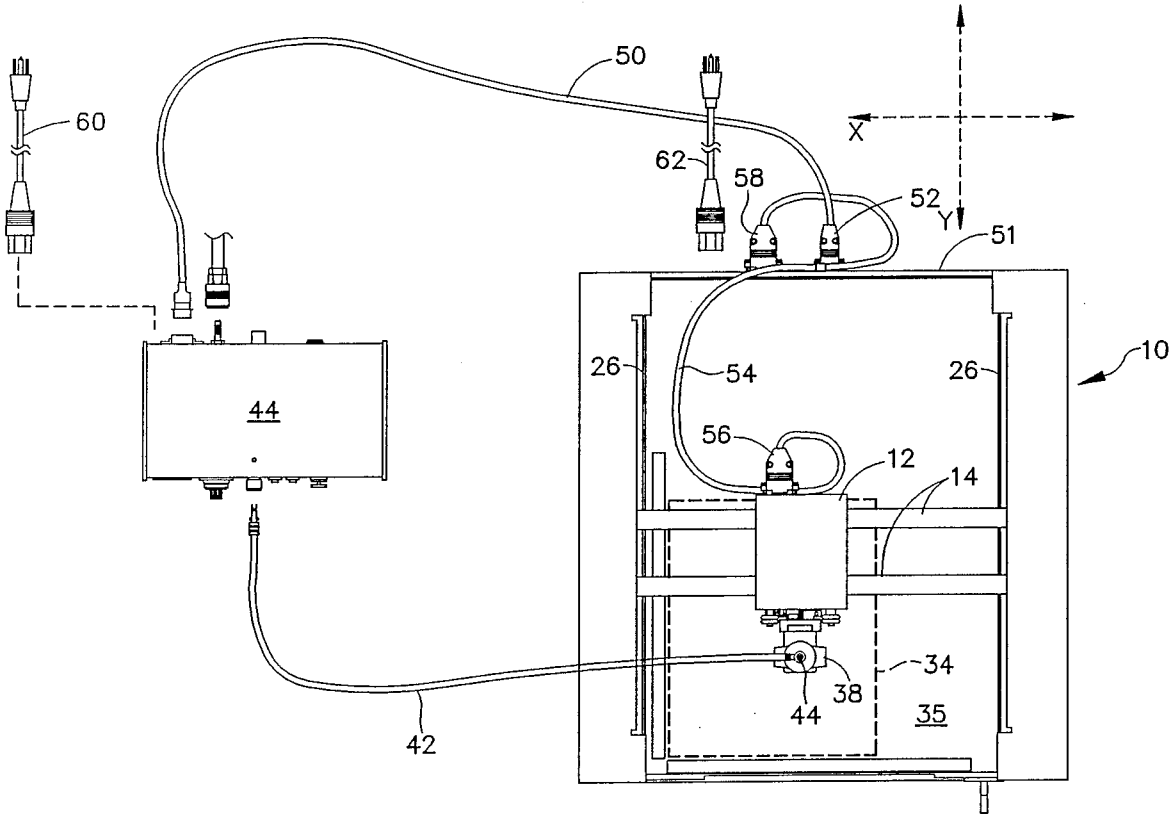
FIG. 1 is a plan view of a preferred embodiment of an automated viscous material dispensing apparatus in accordance with our invention.
Figure 2:
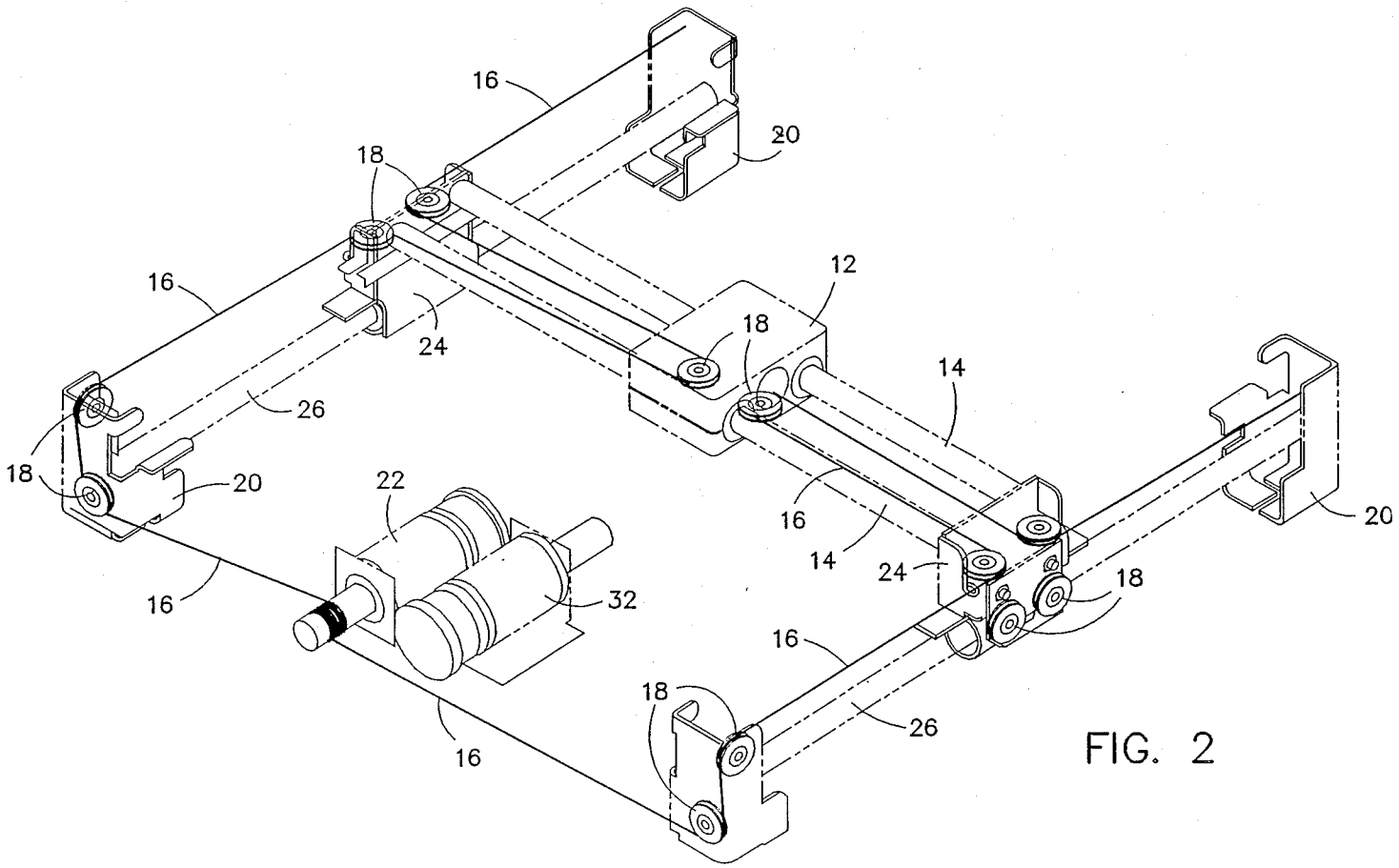
FIGS. 2 and 3 are enlarged perspective views illustrating the X-cable and Y-cable drive mechanisms of the apparatus of FIG. 1, respectively. These figures illustrate some common structure, and omit some structure for the sake of clarity.
Figure 3:
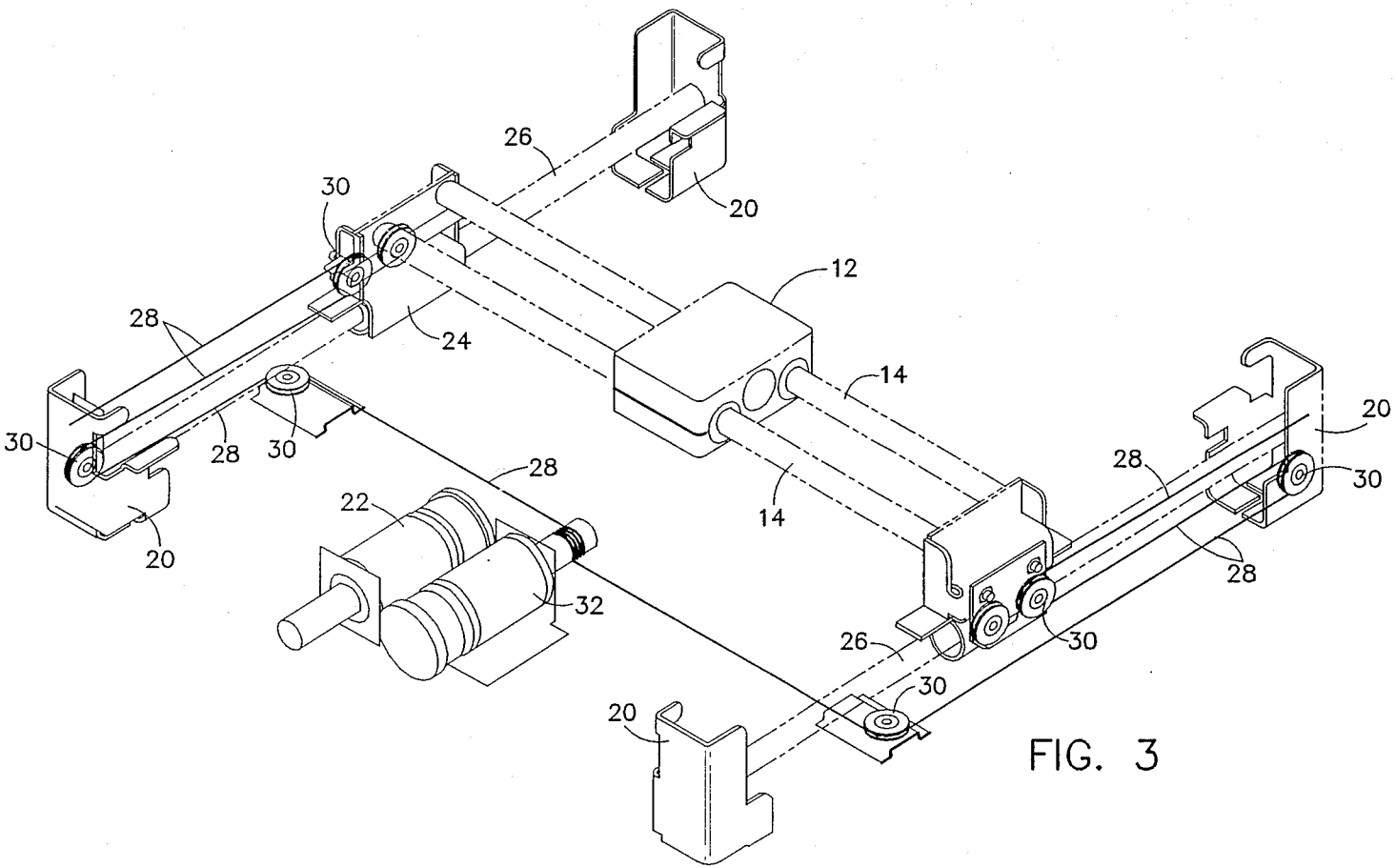

Referring to FIG. 1, the mechanical portion of the illustrated embodiment of our apparatus includes a rectangular frame 10 which supports a carriage 12 for rapid motion along the X and Y axes. The carriage 12 rides along a spaced pair of X-rails 14. The carriage is moved back and forth along the X axis by a first steel cable 16 (FIG. 2) pulled about a series of appropriately located pulleys 18. The ends of the first cable are secured to the rearmost pair of four end frame pieces 20. The intermediate portion of the first cable is wound about the shaft of a first stepper motor 22. The ends of the X-rails 14 are rigidly secured to respective side frame pieces 24 (FIG. 3) which in turn ride along respective Y-rails 26. The ends of the Y-rails are in turn rigidly connected to the rearmost end frame pieces 20. The side frame pieces 24, and thus the X-rails 14 and carriage 12, are moved back and forth along the Y axis by a second steel cable 28 pulled about a series of pulleys 30. The ends of this second cable are also secured to the right rear and left front end frame pieces 20. The intermediate portion of the second cable is wound about the shaft of a second stepper motor 32. The stepper motors 22 and 32 can be independently energized, alone or simultaneously, to move the carriage 12 above a workpiece such as a printed circuit board 34 illustrated in phantom lines in FIG. 1. The PC board is supported on an upper planar support surface or platen 35 of the frame 10, spaced from and beneath the carriage 12.

Figure 4:
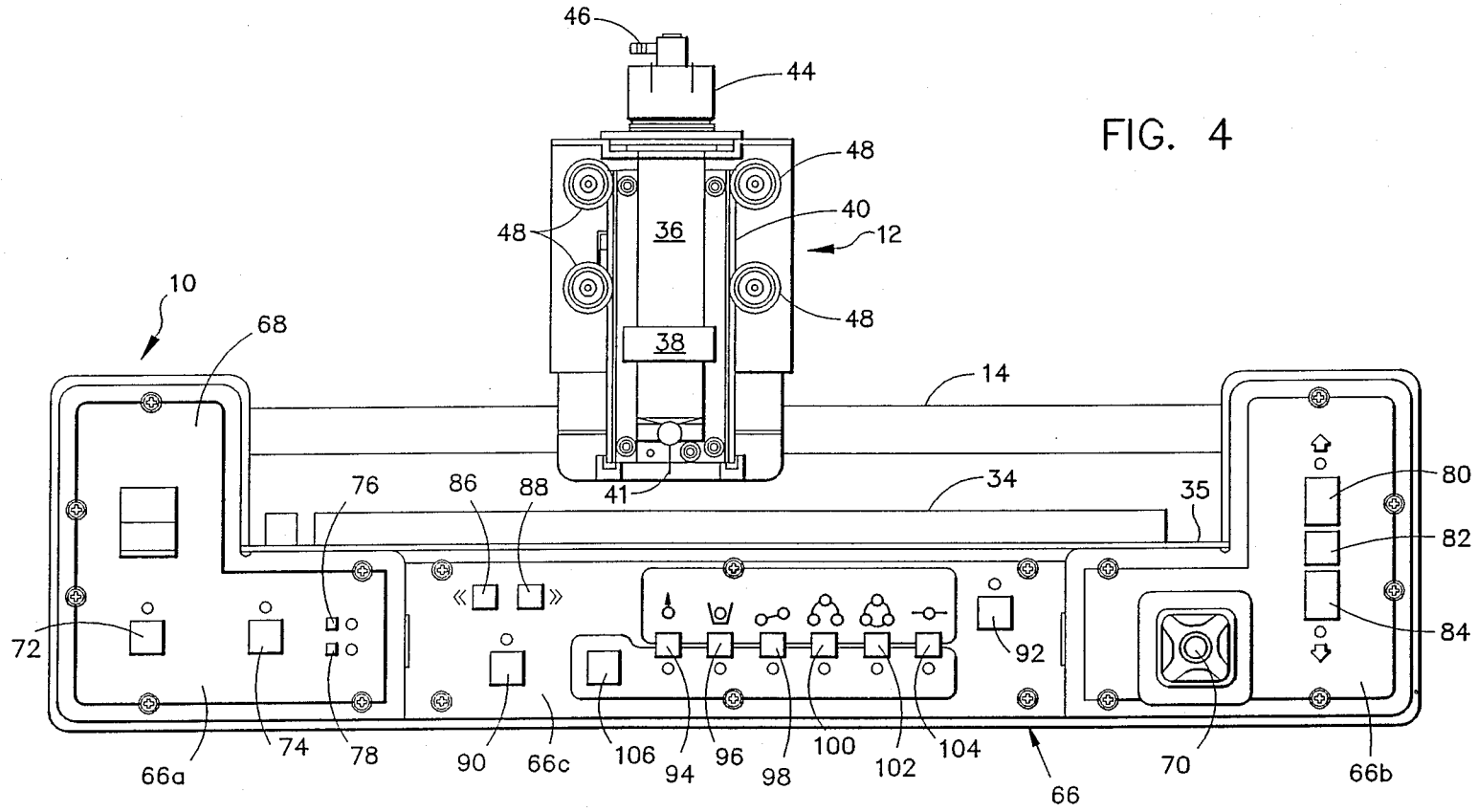
FIG. 4 is an enlarged front elevation view of the apparatus of FIG. 1 illustrating details of its carriage and control panel.

Referring again to FIG. 4, a syringe or any other dispensing device 36 connectable to a standard dispensing control unit (DCU) is mounted in a holder 38 connected to a vertically reciprocable assembly 40 mounted to the forward face of the carriage 12. The syringe has a hollow needle 41 with an open tip for dispensing minute amounts of a quantity of a viscous fluid contained within the barrel of the syringe in response to metered amounts of pressurized air or other gas supplied thereto. An air output hose 42 (FIG. 1) of the DCU 44 is connected to a receiver head 44 coupled to the upper end of the syringe via fitting 46 (FIG. 4). The assembly 40 has opposing guide rollers 48 and electrically powered mechanism (not shown) for raising and lowering the syringe along the Z axis.

One suitable commercially available DCU is the TSI 977 Precision Vacuum Varimeter. Another suitable DCU is the Model 1000XL commercially available from J.A. Crawford Co. 11813 E. Slauson Avenue, Santa Fe Springs, Calif., 90670. Other DCU's may be used or their functional components integrated directly into the frame 10.

Where a conventional stand-alone DCU is used, a cable 50 (FIG. 1) that normally connects to a foot pedal (not shown) for actuating the air supply is instead connected to a first jack (not shown) on a rear panel 51 of the frame 10 via electrical connector 52. This first jack is in turn connected to the electronic portion of the apparatus hereafter described. A Z axis cable 54 is connected to a Z-axis motor (not shown in FIGS. 1–4) inside the carriage 12 via connector 56 and to second jack on the rear panel via connector 58. This second jack is also connected to the electronic portion of the apparatus. The Z-axis motor 59 (FIG. 5) inside the carriage may thus be selectively energized to raise and lower the syringe via a drive train that powers the slide 40 guided by the rollers 48 (FIG. 4). AC power cords 60 and 62 connected to the rear panels of the DCU and frame 10 may be plugged into standard 110 volt AC power duplex outlets. A hose 64 connects an inlet fitting on the DCU to a source of pressurized air (not shown).

The front control panel 66 (FIG. 4) of the frame 10 has a plurality of push buttons which readily allow a user to "teach" the apparatus to dispense dots, potting sequences, continuous lines, arcs, etc. Adjustments can be made to the dispensing quality, speed and amount of material dispensed. A rocker-type ON/OFF switch 68 is mounted on the left control panel section **66*a*. A joy stick 70 is mounted on the right control panel section 66*b*. The remainder of the command devices on the control panel are pushbutton switches. They include, on the left section of the control panel, a STOP switch 72, a GO/PAUSE switch 74, a PROGRAM 1 switch 76 and a PROGRAM 2 switch 78. The circles next to the switches 72, 76 and 78 represent LEDs that are illuminated to indicate the status of these switches. UP, FAST and DOWN switches 80, 82 and 84, respectively, are mounted on the right control panel section. Adjacent LEDs illustrated as circles indicate the status of the up and down switches. BACK, FORWARD, DELETE and EDIT switches 86, 88 90 and 92 are mounted on a center section 66*c*** of the control panel. The circles adjacent the DELETE and EDIT switches represent LEDs which indicate the status thereof.

Six discrete and dedicated dual-mode function switches 94, 96, 98, 100, 102 and 104 are mounted in a linear arrangement in the center section of the control panel. These switches control one set of corresponding functions when an adjust mode switch 106 is actuated and a second set of corresponding functions when the edit mode switch 92 is actuated. A status indicating LED is mounted below each of these six switches. When they are in their edit mode, the six switches 94, 96, 98, 100, 102 and 104 are used to select DOT, POT, LINE, ARC, CIRCLE and NO-FLUID pattern functions, respectively. When they are in their adjust mode, the six switches 94, 96, 98, 100, 102 and 104 are used to control DOT SIZE, POTTING TIME, SPEED, VALVE START-UP, VALVE SHUT-OFF and PURGE fluid flow functions, respectively.

Figure 5:
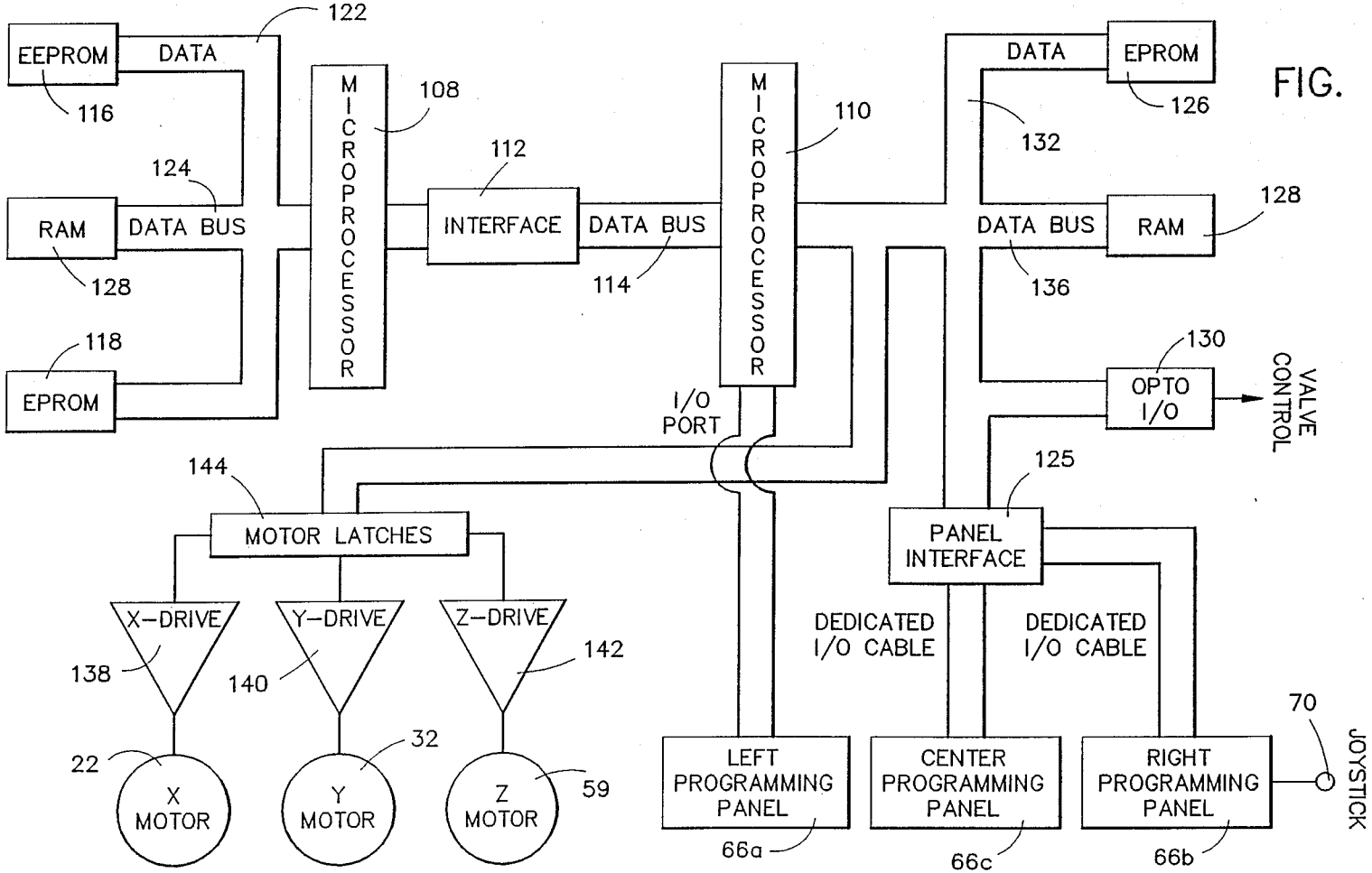
FIG. 5 is a functional block diagram of the electronic portion of the apparatus of FIGS. 1 and 4.

Referring to FIG. 5, the electronic portion of the apparatus includes dual microprocessors 108 and 110 which communicate with each other via interface 112 and data bus 114. By way of example, the microprocessor 108 may be an INTEL 8085 device and the microprocessor 110 may be a MOTOROLA 6803 device. The microprocessor 108 communicates with memory in the form of EPROMs 116 and EPROMs 118 and RAM 120 via data buses 122 and 124. The microprocessor 110 is used to input information from the control panel for motion setup processing by microprocessor 108. The microprocessor 110 communicates with the left control panel section **66*a* via its I/O port, and with the center and right control panel sections 66*c* and 66*b* via panel interface 125. Memory in the form of EPROM 126, RAM 128 and an optical I/O device 130 are connected to the microprocessor 110 via data buses 132 and 134. The microprocessor 110 is also used for joystick positioning control of the X-Y motion of the syringe, Z motion control of the syringe, valve control as well as real time X-Y-Z motion control of the syringe during program execution. The X, Y and Z-axis stepper motors 22, 32 and 59 are energized via corresponding drive circuits 138, 140 and 142, respectively. The drive circuits are in turn selectively actuated by the microprocessor 110 via motor latches 144. The microprocessor 108** is used to compute the necessary motion setup parameters such as velocity, acceleration, vector length, arc center, arc length, as well as the dispensing parameters.

It will be understood that our apparatus does not require connection to any external computer in order to program the desired motions and dispensing functions. Instead, computer programs in the form of firmware are stored in the memories of the electronic portion of the apparatus for enabling the desired dispensing motions and functions to be readily programmed simply by pushing the appropriate pushbutton switches on the control panel in the appropriate sequence. The computer programs are designed so that a user can run a demonstration to gain familiarity with the apparatus. They are further designed so that the user can "teach" the apparatus a specific sequence of movements and dispensing functions in order to perform a specific production job. Multiple such "workpiece" programs may stored in the apparatus for recall and use at any time.

The joystick 70, as well as the UP and DOWN pushbutton switches 80 and 84 provide a manually actuable position input means for direct real time positioning of the tip of the dispensing needle along the X, Y and Z axes. The joystick moves the needle 41 of the syringe 36 around the dispensing area which is within the region defined by planar support surface 35 (FIG. 1) of the frame 10. The further an operator pushes the joystick, the faster the needle moves. The UP and DOWN pushbutton switches can be depressed by the operator to raise and lower the needle the desired amount. The operator can push the FAST pushbutton switch 82 simultaneously with either the UP or the DOWN pushbutton in order to raise or lower the needle at a faster rate.

The creation of a workpiece program will now be narratively described. Each move of the needle is called an element. An element is defined by one or more points taught by the operator. Usually, a blinking LED indicates which pushbuttons must be depressed next in order to continue teaching. As each point for an element is defined, that point is stored in memory. When all points are defined, that element will take place in the sequence and at the location where the operator taught it.

First, a workpiece (such as a printed circuit board) 34 is placed on top of platen 35 as illustrated in FIG. 1. The workpiece is secured in position on top of the platen by suitable means such as magnets (not illustrated). The operator then turns on the DCU, sets the timer control OFF (steady mode ON) and sets the air pressure to a suitable 15 level, such as 30 PSI.

The operator then actuates the ON/OFF rocker switch 68 (FIG. 4) to turn on the apparatus. The apparatus always checks the amount of memory available for storing workpiece programs as soon as it is turned on. The needle first moves to the right rearmost position above the platen 35. Thereafter the needle moves straight to the left. The needle movement works like a gauge in that the distance the needle moves to the left across the platen tells the operator how full the memory is. For example if the needle moves half way across the platen, the memory is half full. If it moves all the way across, the memory is full and any attempt to enter a workpiece program will only cause the machine to provide an audible beep. By way of example, the memory of the apparatus preferably has room for storing about 1000 dots, 500 unjoined lines, or 300 arcs/circles.

In order to teach the apparatus a workpiece program, the operator initially presses the PROGRAM 1 pushbutton switch 76 in order to tell the apparatus that a workpiece program is about to be taught. The operator then presses the EDIT pushbutton switch 86. The dispensing needle 41 should not move. This verifies that no program is presently stored in the memory for PROGRAM 1. The operator then uses the UP/DOWN pushbutton switches 80 and 84 to adjust the height of the tip of needle 41 to the correct height above the PC board 34. Since the workpiece, i.e. PC board 34, is substantially flat, the operator need only select one needle height. If necessary during the production operation, different needle heights may be programmed for each element. The operator uses the joystick 70 to move the needle to a reference point (first dot). The reference point is the starting place for the workpiece program. If it varies, then every other point in the workpiece program will vary. The operator then presses the EDIT pushbutton. The LED adjacent the EDIT pushbutton will go from blinking to steady and all of LEDs above 94, 96, 98, 100 and 104 switches will start blinking. With the needle in position above the first dot, the operator presses the DOT pushbutton 94. The apparatus then gives an audible beep in order to tell the operator that the dot has been taught. The LED adjacent the DOT pushbutton goes from blinking to steady to tell the operator that the apparatus is currently at a dot in the dispensing sequence.

The operator then proceeds throughout the PC board, teaching each element as described below. While teaching, the apparatus provides audible and visible signals through each teaching cycle. One kind of audible beep is given when the operator teaches the first point of a multiple-point element and another kind of audible beep is given when the operator teaches the final point. A blinking LED during element teachings signals the next point to be taught, while a steady LED tells the operator that he or she has just finished teaching that element.

A dot consists of a very small substantially round quantity of the viscous material. A pot consists of a significantly larger quantity of the viscous material. In order to teach a dot or a pot at a given location on the PC board, the operator moves the needle to the desired location using the joystick. Once the needle is at the desired location, the operator depresses the DOT pushbutton switch 94 or the POT pushbutton switch 96, as desired. The apparatus then provides the appropriate audible beep and the applicable LED goes from blinking to steady.

In order to apply a straight line of the viscous material the operator moves the needle to the beginning point in the joystick. At the beginning point the operator presses the LINE pushbutton switch 98. The apparatus then beeps and the line end (second) LED begins blinking. The operator then moves the needle to the line end point and depresses the LINE pushbutton switch 98 a second time. The apparatus then provides an audible beep and the line start (first) LED is illuminated in steady fashion.

In order to teach an arc, the operator first moves the needle to the beginning point. He or she then depresses the ARC pushbutton switch 100. The apparatus provides an audible beep and the arc middle (second) LED begins blinking. The operator then moves the needle to a point about midway along the arc and again depresses the ARC pushbutton switch. The apparatus again beeps and the arc end (third) LED begins blinking. Finally, the operator moves the needle to the end of the arc and depresses the ARC pushbutton again. The apparatus then beeps again and the arc start (first) LED is illuminated in steady fashion.

In order to teach a circle, the operator first moves the needle to any point along the circumference of the desired circle and depresses the CIRCLE pushbutton switch 102. The apparatus then provides an audible beep and the circle middle (second) LED begins blinking. The operator then moves the needle to a point about one-third of the way around the circumference of the circle and depresses the CIRCLE pushbutton switch again. The apparatus again beeps and the circle end (third) LED begins blinking. The operator then moves the needle to a point about two-thirds of the way around the circumference and depresses the CIRCLE pushbutton switch a final time. The apparatus then beeps again and the circle start (first) LED is illuminated in steady fashion. If the operator teaches all three circle points in a straight line, the apparatus will provide an audible beep and the circle start LED will not light in steady fashion after the operator teaches the third point. No circle will then be taught.

For a no-fluid element (to move from one position to another without depositing a viscous material), the operator moves the needle to the location in height where he or she wants the move to end and then depresses the NO-FLUID pushbutton switch 104. The apparatus provides an audible beep and the LED adjacent the pushbutton switch 104 is illuminated in steady fashion.

In order to create squares and irregular shapes on the workpiece, the operator simply joins elements. For example an arc can be joined at the end of a straight line. The apparatus backtracks at the end of each line or arc. This breaks the fluid bead so that there is no tail at the end of the line or arc. However, if the operator starts one line from the point where he or she just ended another, the apparatus will dispense a continuous bead of the viscous material without backtracking. Therefore the operator can combine lines or arcs to form a continuous bead of viscous material in a complex shape. When joining lines to lines or arcs to arcs, the applicable function button must be depressed twice at the connection point without moving the needle. When joining a line and an arc, the operator must depress the LINE pushbutton switch at the end point, and then without moving the needle, depress the ARC pushbutton switch to begin the arc. If the operator moves the needle in between two elements, they will not be joined. He or she may then depress the BACK or FORWARD pushbutton switches 86 or 88 in order to recover.

A square of viscous material may be deposited on the PC board at the appropriate location by teaching four joined lines of equal length. Areas may be painted by placing parallel lines of equal length close to each other so that the dispensed viscous material flows together like paint. By teaching the start of each line or arc exactly where the previous one ended, almost any shape can be created. The operator continues teaching each element of the workpiece program until he or she is finished. If the workpiece program is to be deleted from the PROGRAM 1 memory, the DELETE pushbutton switch 90 is depressed. Similarly, another workpiece program can be taught by depressing the PROGRAM 2 pushbutton switch 78 and then teaching the various elements as described above.

If the operator wants to change a particular workpiece program in any way, he or she can do it while teaching the initial sequence, or while editing it later. If a mistake is made and recognized during or immediately after teaching a particular element, the operator simply depresses the DELETE pushbutton switch 90 and reteaches the element correctly before teaching the next. At any time during the teaching, the operator can use the BACK and FORWARD pushbutton switches 86 and 88 (FIG. 4) to move an incorrect element. If the operator wants to delete a series of elements, the operator simply moves to the last element and depresses the DELETE pushbutton switch to delete the unwanted elements. The apparatus always deletes the current element, and then moves back to the prior one.

In order to insert a new element, the operator moves to the element before the point where he or she wanted to make the insertion. A new element is automatically inserted after the current one. The operator depresses the BACK and FORWARD pushbutton switches 86 and 88 to see where he or she is in the workpiece program. In order to move directly to the beginning of the program, the operator can depress the FAST pushbutton 82 switch and then simultaneously depress the BACK pushbutton switch 86. In order to move directly to the end of the workpiece program. the operator may similarly simultaneously depress the FAST and FORWARD pushbutton switches.

Fluid flow can be adjusted at any time, including when a sequence is running. This mode actutally adjusts either how fast the needle travels or how long the dispensing valve stays open. The adjust mode uses the same pushbuttons as the edit mode, but the functions are different. The status of these functions is shown on the LEDs below the pushbutton switches 94, 96, 98, 100, 102 and 104. The adjust mode is selected simply by depressing the ADJUST pushbutton switch 106 until all of the LEDs below the aforementioned function pushbutton switches are blinking. The adjustments and their effects are as follows. The DOT SIZE pushbutton switch 94 may be depressed to determine how long the valve stays open to make a dot. POT TIME pushbutton switch 96 may be depressed to determine how long the valve stays open to fill a cavity. The SPEED pushbutton switch 98 may be depressed to determine how fast the needle travels, and therefore the thickness of the line, arc and circle elements. Air pressure can also be adjusted at the DCU in order to determine the line thickness.

The VALVE STARTUP pushbutton switch 100 may be depressed to determine how long the valve stays on before the needle moves in a line, arc, or circle. The VALVE SHUT-OFF pushbutton switch 102 may be depressed to determine how far from the end of an arc, line, or circle the valve turns off. Finally, the PURGE pushbutton switch 104 may be depressed to determine how long the valve stays open while the needle is being purged.

To reiterate, in order to adjust all fluid flow functions except the potting time and purge, the operator depresses the ADJUST pushbutton switch 106. The LEDs below each of the six function switches then start blinking, in order to prompt the operator to select one. The operator then depresses the pushbutton switch for the function he or she wants to adjust. In order to adjust the potting time, the POT TIME pushbutton switch is depressed when the needle is over the desired location and material is dispensed. When the potting area is full, the POT TIME pushbutton switch is released. The ADJUST pushbutton switch is then depressed to store the potting information. The purge function may be selected by depressing the PURGE pushbutton switch. The operator should hold a cup under the needle so that the purges material can be gathered.

Figure 6:
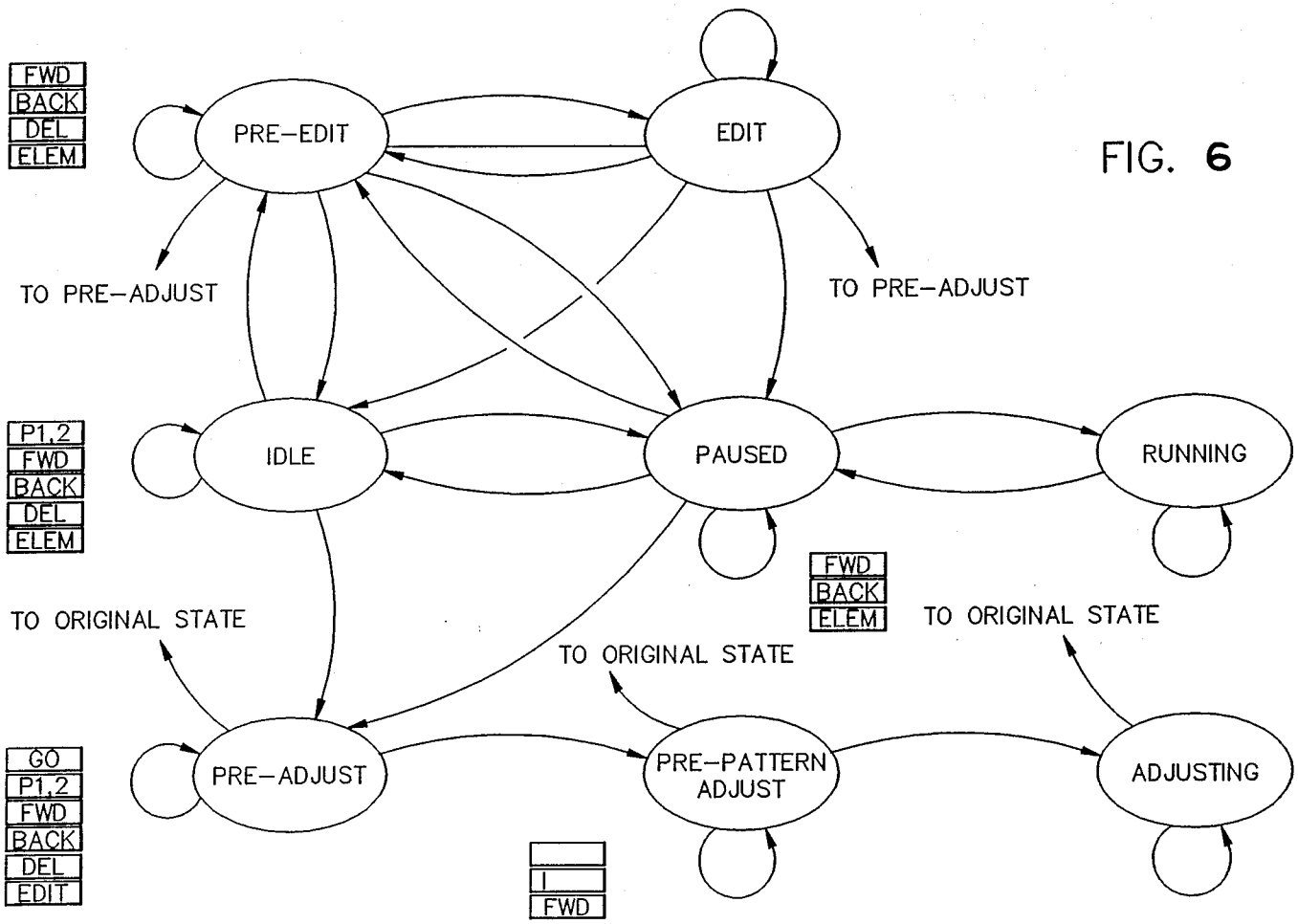
FIG. 6 is a state diagram of the logic performed by the electronic portion of the apparatus illustrated in FIG. 5.

FIG. 6 is a state diagram of the logic performed by the electronic portion of the apparatus illustrated in FIG. 5. The following pushbutton switches on the control panel affect the main state:

| SWITCH | CLASS | ALTERNATE FUNCTION |
|---|---|---|
| Adjust | ADJ | (none) |
| Edit | EDIT | (none) |
| Dot | ELEM | Dot Size |
| Pot | ELEM | Pot Time |
| Line | ELEM | Speed |
| Arc | ELEM | Valve Startup |
| Circle | ELEM | Valve Shutoff |
| No Fluid | ELEM | Purge |
| Program 1 | P1, 2 | (none) |
| Program 2 | P1, 2 | (none) |
| Delete | DEL | (none) |
| Forward | FWD | (none) |
| Back | BACK | (none) |
| Go | GO | (none) |

Referring to FIG. 6, each pushbutton switch is a member of class of switches, as shown. All switches in a given class produce the same state transitions. Some of the switches have an alternate function which is active during the PRE-ADJUST, PRE-PATTERN ADJUST, and ADJUSTING states. The STOP switch 72 is not included in the above table. It always produces an immediate transition to the EMERGENCY STOPPED state. The EMERGENCY STOPPED state can only be exited by turning off the power.

At power up the apparatus enters the IDLE state. In the state diagram each ellipse represents a state. Each arrow represents a transition from a state, either to itself or to another state. Each box is used to label an arrow. The box shows which class of switches produces the associated state transition. Those arrows labeled "TO ORIGINAL STATE" indicate a return to whichever state preceded the PRE-ADJUST state. Many state transitions are accompanied by some action, such as a motion of the fluid dispensing needle, a recording of some information in the nonvolatile memory, or an audible tone. For simplicity, these actions have been omitted from FIG. 6.

Thus it can be appreciated that the apparatus can be readily "taught" a complex sequence of dispensing patterns and fluid flow functions, making the occasional user an expert. The requirement of previous automated X-Y-Z dispensers of having IBM-PC compatible programming skills is eliminated. The apparatus can operate at high speed with great precision for long periods of time without operator assistance, other than the refilling of the syringe.

While we have described several preferred embodiments of our method and apparatus for dispensing viscous materials, it should be understood that modifications and adaptations thereof will occur to persons skilled in the art. Therefore, the protection afforded our invention should only be limited in accordance with the scope of the following claims.

We claim:

1. An apparatus for dispensing viscous materials, comprising:

frame means for supporting a generally planar workpiece;

a carriage;

means supported on the carriage for holding a dispensing device connectable to a dispensing control unit, the dispensing device being adapted for dispensing a viscous material to be dispensed therefrom in response to a control signal being applied to the dispensing control unit;

means connected to the frame means for mounting the carriage for independent movement along an X axis and a Y axis to position a tip of the dispensing device above a preselected location on an upper surface of the workpiece;

first drive means mounted to a frame means for moving the carriage along the X axis in response to a first drive signal applied thereto;

second drive means mounted to the frame means for moving the carriage along the Y axis in response to a second drive signal applied thereto;

drive circuit means for generating the first and second drive signals and applying them to the first and second drive means;

manually actuable position input means mounted to the frame means for positioning the tip of the dispensing device along the X and Y axes;

a plurality of discrete manually actuable function switches mounted to the frame means for enabling the operator to select corresponding pattern and fluid flow functions;

memory means for storing a program; and processor means connected to the dispensing control unit, drive circuit means, position input means, function switches and memory means for enabling the operator to create a workpiece program by positioning the tip of the dispensing device above preselected locations on the upper surface of the workpiece through manual actuation of the position input means and by defining the movement of the tip between consecutive locations and the dispensing of the viscous material onto the upper surface between consecutive locations by manual actuation of the function switches, for storing the workpiece program in the memory means, and for automatically executing the workpiece program on command by generating and applying the first and second drive signals and the control signal required to dispense the viscous material over the upper surface of the workpiece as prescribed by the operator.

2. An apparatus according to claim 1 wherein the pattern functions are selected from the group consisting of a dot, a pot, a line, an arc, a circle and no-fluid.

3. An apparatus according to claim 1 wherein the fluid flow functions are selected from the group consisting of dot size, potting time, speed, valve start-up, valve shut-off and purge.

4. An apparatus according to claim 1 and further comprising a plurality of means connected to the processing means for providing a visual indication of a status of the function switches 5. An apparatus according to claim 1 wherein the processor means actuates the visual indication means to lead an operator through a series of steps of actuating selected function switches to thereby create the workpiece program.

6. An apparatus according to claim 1 and further comprising means connected to the carriage for mounting the dispensing device for vertical reciprocation along a Z axis.

7. An apparatus according to claim 6 and further comprising third drive means mounted to the carriage for moving the dispensing device along the Z axis in response to third drive signals applied thereto by the drive circuit means.

8. An apparatus according to claim 7 wherein the manually actuable position input means is actuable to adjust the height of the tip of the dispensing device relative to the upper surface of the workpiece.

9. An apparatus according to claim 1 wherein the processor means includes means for permitting the workpiece program to be edited at any stage thereof and the apparatus further includes a plurality of discrete manually actuable switches for permitting the stage of the program to be edited to be accessed.

10. A method for dispensing viscous materials, comprising the steps of:

providing a dispensing control unit;

providing a dispensing device for holding a quantity of a viscous material to be dispensed through a tip thereof;

coupling the dispensing device to the dispensing control unit so that the dispensing device will dispense a predetermined amount of the viscous material from the tip in response to a dispensing unit control signal;

providing a frame and drive assemblies for independently moving the syringe along X, Y and Z axes in response to first, second and third drive signals;

selecting predetermined pattern and fluid flow functions for each of a plurality of consecutive movement elements of the dispensing device by actuation of corresponding discrete manually actuable switches to thereby create a workpiece program; and automatically executing the workpiece program on command by generating and applying the first, second and third drive signals and the dispensing unit control signal required to dispense the viscous material over the upper surface of the workpiece as prescribed.

* * * * *